United States Patent [19]

Murphy

[11] 4,368,835

[45] Jan. 18, 1983

[54] BACK CARRIER

[76] Inventor: Arthur D. Murphy, 439 Coe Ave., East Haven, Conn. 06512

[21] Appl. No.: 208,996

[22] Filed: Nov. 21, 1980

[51] Int. Cl.[3] ..... B62B 1/20

[52] U.S. Cl. ..... 224/153; 224/151

[58] Field of Search ..... 224/153, 151; 280/47.18, 47.24

[56] References Cited

U.S. PATENT DOCUMENTS

| | | | |
|---|---|---|---|
| 493,348 | 3/1893 | Barry et al. | 224/151 |
| 2,401,986 | 6/1946 | Talbot | 224/153 X |
| 3,144,014 | 8/1964 | Mantell, Jr. | 224/153 X |
| 3,550,997 | 12/1970 | Strand | 224/153 X |
| 4,037,765 | 7/1977 | Slayman | 224/151 X |

*Primary Examiner*—Steven M. Pollard

*Attorney, Agent, or Firm*—Costas, Montgomery & Dorman

[57] ABSTRACT

A back pack formed of spaced apart hollow tubular members open at the lower end where each support member receives a shaft with each of the shafts supporting an axle extending therefrom and a wheel on each axle.

7 Claims, 2 Drawing Figures

BACK CARRIER

BACKGROUND OF THE INVENTION

This invention relates to improvements in a back carrier. In particular, this invention relates to improvements in a back carrier of a type comprising a heavy-duty frame supporting a pack.

There are a number of recent innovations and designs in the art of back carriers. Much of the recent art is a product of the increasing popularity of the sport of backpacking. A number of the recent advances in design and structure have been directed to providing for a more desirable weight distribution in relation to the back-carrying anatomical structures of the human body. A number of recent advances have also been directed to providing for increased comfort to the porter. While the state of the art is substantially developed with respect to the foregoing features of back carriers, the present invention is designed to improve and supplement the advantages and desirable qualities of back carriers, particularly those directed to heavy-duty load carrying capabilities.

SUMMARY OF THE INVENTION

This invention further improves upon back carriers by means of a pair of wheels mounted at the lower end of the frame support members. Each wheel is axially mounted to a support shaft which is inserted into the lower end of the frame support members of the back carrier. The wheels may be further secured to the back carrier by means of a pin which can also be employed to connect support straps to the support member.

OBJECTS OF THE INVENTION

An object of this invention is to provide a new and improved back carrier which is capable of transporting loads by pushing or pulling the carrier in addition to conventional back-carrying means.

An object of the invention is to provide a multi-purpose carrier which allows for a relatively easy employment in situations or terrains where back-carrying is not feasible or possible.

An object of the invention is to provide for a new and improved back carrier, which is relatively easy and inexpensive to manufacture.

A still further object of this invention is to provide for a new and improved back carrier which is capable of being pushed or pulled across a surface and also may be easily secured in an upright position when not being used.

Other objects of the invention will become apparent from the detailed description and accompanying drawings.

DETAILED DESCRIPTION

Figure 1:
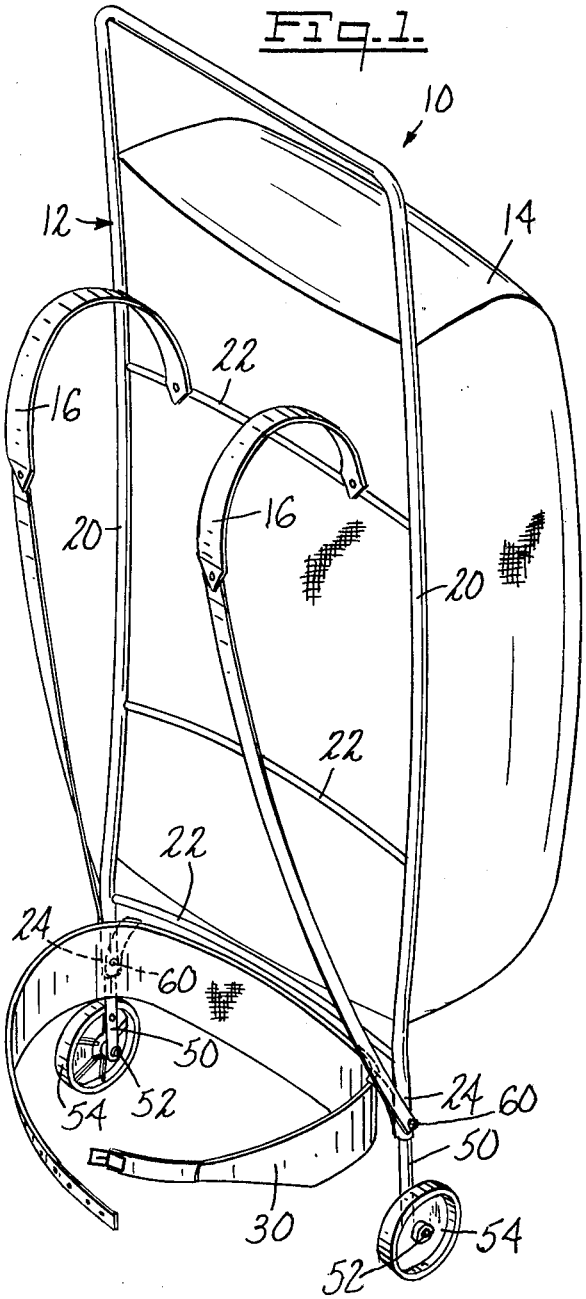
FIG. 1 is a perspective view of a new and improved back carrier.

With reference to FIG. 1, a back carrier for mounting on the back of person to facilitate the transporting of various loads is shown generally as 10. Back carrier 10 comprises a frame 12 supporting a pack 14. Frame 12 comprises parallel vertical support members 20 and horizontal support members 22. Frame 12 may comprise a unitary structure as illustrated in FIG. 1 or it may comprise a structure wherein the frame is comprised of a plurality of individual components. Support members 20 may take a variety of forms and shapes including structural configurations where support members 20 are only substantially parallel and vertical. Support members 20 and 22 may be tubular structures of lightweight material such as aluminum. It is of particular import that each of support members 20 comprise at the lower end 24, an essentially tubular structure.

A pair of shoulder straps 16 connect from either support members 20 or horizontal supports 22. Carrier 10 may be further provided with a support strap 30 of a flexible material which is designed to provide additional support by means of wrapping around the porter in the lower abdomen or the kidney area. A number of other auxiliary support straps may be provided. It should also be noted that support strap 30 and the lower end of strap 16 may connect to the frame 12 at a point on the tubular support members 20 proximate the lower end 24.

All of the foregoing description is intended to be generally illustrative of back carriers of a wide variety of size, shape and configurations, many of such carriers being properly called backpacks. The present invention is not limited to an improvement of a back carrier specifically limited by the foregoing description. This invention relates to improvements in back carriers of any type provided such carriers have substantially vertical support members having a tubular lower end structure.

Applicant's invention comprises a pair of wheels each mounted at the lower end of a support member 20. The detailed description will be directed to a description related to one of said wheels, it being understood that the entire invention comprises, in addition, an identical second wheel/carrier structure.

Figure 2:
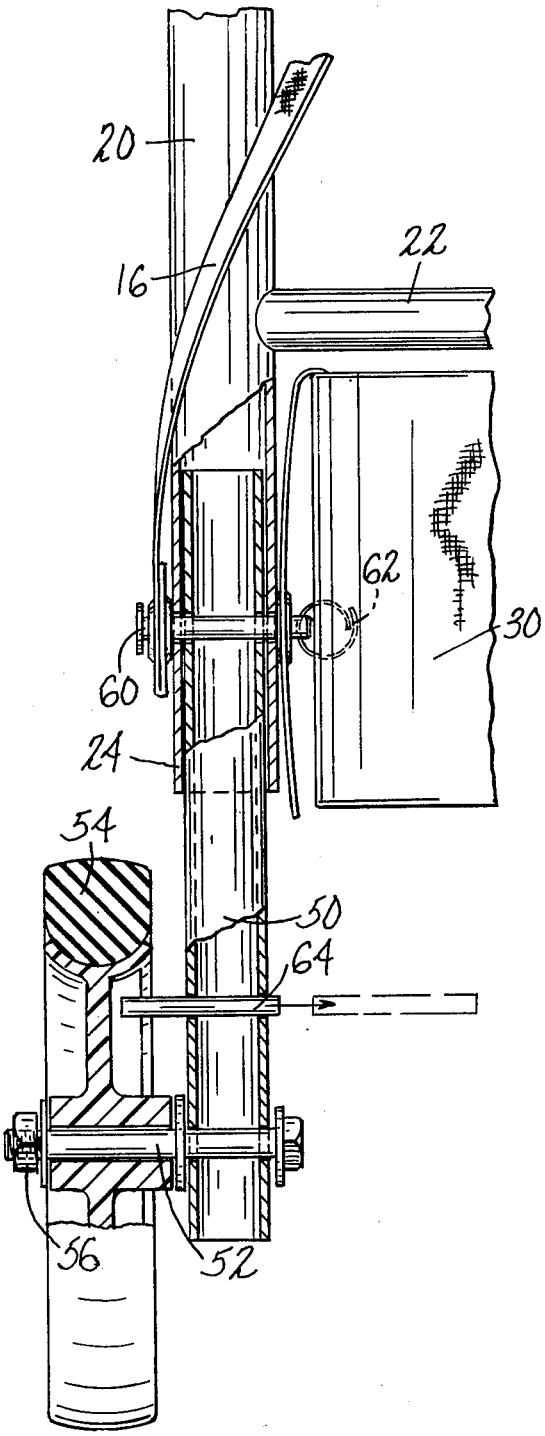
FIG. 2 is an enlarged partial view of the back carrier of FIG. 1, partly in section.

With reference to FIG. 2, a support shaft 50 which is of substantially cylindrical enlongated form is inserted into the lower end 24 of the support member 20. It is preferred that the diameter of support shaft 50 be substantially commensurate with the inside diameter at the lower end 24 of support member 20.

Support shaft 50 receives axle 52 upon which is rotatably mounted a wheel 54. Wheel 54 may be secured to axle 52 by nut 56 or other conventional means. Wheel 54 should be constructed of a light-weight material and should be of a diameter which is small enough so that the wheel does not interfere with normal body motion or contact the body of the porter when the back carrier is mounted for transporting purposes.

The support shaft 50 may be secured in the lower end 24 in a number of ways. The shaft 50 may be secured by epoxy or a similar adhesive, a clamp may be used to compress the lower end 24 to hold the support shaft in position, or a pin 60 may be inserted through lower end 24 and support shaft 50. Pin 60 may be secured by means of a clip 62 inserted through the end of pin 60. As illustrated in FIG. 2, pin 60 may be further employed to fasten strap 30 to support member 20 as well as to secure shoulder strap 16.

It is readily apparent that applicant's invention provides a carrier that may be either mounted on the back or may be employed in a manner analogous to a hand-cart, i.e. pushed or pulled across a surface.

While wheels 54 may be mounted in such a way that they are free to rotate relative to support shaft 50, in practice, it is generally advantageous if the plane of rotation of wheels 54 is substantially orthogonal to the plane defined by support members 20. The absence of freedom of pivot of axle 52 lends stability of motion to the back carrier and minimizes the effects of sudden stress when the carrier is pushed or pulled along uneven surfaces.

A brake pin 64 which is slidably received in support shaft 50 is constructed so as to be frictionally engageable against wheel 54 in such a manner that in a first position, wheel 54 is prevented from rotating and in a second position, wheel 54 is free to rotate. Thus, the brake pin by preventing wheel rotation in a first position would allow for the back carrier to be placed on a surface and be positioned in an upright position against a wall or similar structure without the bottom of the carrier rolling away from the wall surface.

It will be seen from the previous description, that applicant's invention is easily adaptable for use in connection with a conventional back carrier to provide for a new and improved carrier having the capability of being either pushed or pulled when the porter is either weary from carrying the carrier on his back, or the terrain conditions do not permit back transport. Of course, the carrier may also be rolled, or pushed or pulled when the individual employing same is confined within a narrow corridor or a closed environment.

I claim:

1. In a back carrier of the type having two substantially parallel tubular support members adapted to be fitted generally vertically to the back of a person, said members having tubular lower ends, wherein the improvement comprises: two support shafts, each of said shafts inserted into the lower end of one of said support members; each of said shafts supporting an axle extending therefrom; two wheels, each rotatably mounted on one of said axles, means for securing said shafts in said members and means slidably mounted to at least one of said support shafts for engaging the wheel on said support shaft and preventing rotation thereof.

2. The back carrier of claim 1 wherein said means for securing comprises a pin inserted through said shaft and said member.

3. The back carrier of claim 1 wherein said wheels are rotatable in a plane substantially orthogonal to a plane defined by said support members.

4. The back carrier of claim 1 wherein said slidably mounted means comprises a brake pin received in at least one of said support shafts.

5. A back carrier of the type having two substantially parallel tubular support members adapted to be fitted generally vertically to the back of a person, a pin extending into said members adjacent the lower ends thereof, shoulder straps, said shoulder straps having their lower ends attached to said pins, a shaft inserted into the lower end of each of said members, each of said shafts including an axle extending therefrom, a wheel rotatably mounted on each axle, said pins extending through said shafts and retaining said shafts in said members and means slidably mounted to at least one of said support shafts for engaging the wheel on said support shaft and preventing rotation thereof.

6. The back carrier of claim 5 wherein said wheels are rotatable in a plane substantially orthogonal to the plane defined by said support members.

7. The back carrier of claim 5 wherein said slidable means comprises a brake pin received in at least one of said support shafts.

* * * * *